US008870545B2

(12) United States Patent
Reghezza et al.

(10) Patent No.: US 8,870,545 B2
(45) Date of Patent: Oct. 28, 2014

(54) REINFORCED FAN BLADE SHIM

(75) Inventors: Patrick Jean-Louis Reghezza, Vaux le Penil (FR); Julien Tran, Pontoise (FR)

(73) Assignee: SNECMA, Paris (FR)

( * ) Notice: Subject to any disclaimer, the term of this patent is extended or adjusted under 35 U.S.C. 154(b) by 486 days.

(21) Appl. No.: 13/265,200

(22) PCT Filed: Apr. 28, 2010

(86) PCT No.: PCT/EP2010/055689

§ 371 (c)(1),
(2), (4) Date: Oct. 19, 2011

(87) PCT Pub. No.: WO2010/125089

PCT Pub. Date: Nov. 4, 2010

(65) Prior Publication Data

US 2012/0107125 A1 May 3, 2012

(30) Foreign Application Priority Data

Apr. 29, 2009 (FR) ..... 09 52812

(51) Int. Cl.
*F01D 5/30* (2006.01)
*F01D 25/06* (2006.01)

(52) U.S. Cl.
CPC ..... *F01D 5/3007* (2013.01); *F01D 5/3092* (2013.01); *F01D 25/06* (2013.01)
USPC ..... 416/220 R

(58) Field of Classification Search
CPC ..... F01D 5/26; F01D 5/3092; F01D 5/3007; F01D 5/323; F01D 5/28; F01D 5/326; F04D 29/322; F05D 2260/30; F05D 2250/71
USPC ..... 416/219 R, 220 R, 221, 248, 204 A, 416/241 R, 500
See application file for complete search history.

(56) References Cited

U.S. PATENT DOCUMENTS

| | | | | | |
|---|---|---|---|---|---|
| 2,786,648 | A | * | 3/1957 | Ledwith | 416/221 |
| 4,265,595 | A | * | 5/1981 | Bucy et al. | 416/220 R |
| 4,711,007 | A | * | 12/1987 | Conrad | 29/889.21 |
| 4,980,241 | A | * | 12/1990 | Hoffmueller et al. | 428/607 |

(Continued)

FOREIGN PATENT DOCUMENTS

| | | | |
|---|---|---|---|
| FR | 2 376 958 | | 1/1978 |
| FR | 2 841 609 | A1 | 1/2004 |
| WO | WO 96/41068 | A1 | 12/1996 |

OTHER PUBLICATIONS

International Search Report issued Aug. 5, 2010, in Patent Application No. PCT/EP2010/055689.

(Continued)

*Primary Examiner* — Edward Look
*Assistant Examiner* — Eldon Brockman
(74) *Attorney, Agent, or Firm* — Oblon, Spivak, McClelland, Maier & Neustadt, L.L.P.

(57) ABSTRACT

A shim configured to be inserted between a fan blade root of a turbojet and a bottom of a compartment in which this root is housed, the compartment being delimited by a fan disk. The shim includes a metal stiffener including at least one external element made of an elastomer material, and including a support surface of the external element. The support surface includes at least one corrugated zone.

10 Claims, 3 Drawing Sheets

(56) References Cited

U.S. PATENT DOCUMENTS

| | | | | |
|---|---|---|---|---|
| 5,160,243 | A * | 11/1992 | Herzner et al. | 416/220 R |
| 5,240,375 | A * | 8/1993 | Wayte | 416/219 R |
| 5,282,720 | A * | 2/1994 | Szpunar | 416/220 R |
| 5,356,545 | A * | 10/1994 | Wayte | 508/138 |
| 5,431,543 | A * | 7/1995 | Brown et al. | 416/221 |
| 5,820,347 | A * | 10/1998 | Bussonnet et al. | 416/221 |
| 6,109,877 | A * | 8/2000 | Gekht et al. | 416/221 |
| 6,132,175 | A * | 10/2000 | Cai et al. | 416/220 R |
| 6,398,499 | B1 * | 6/2002 | Simonetti et al. | 416/193 A |
| 6,416,280 | B1 | 7/2002 | Forrester et al. | |
| 6,431,835 | B1 * | 8/2002 | Kolodziej et al. | 416/219 R |
| 6,481,971 | B1 * | 11/2002 | Forrester | 416/221 |
| 6,837,686 | B2 * | 1/2005 | Di Paola et al. | 416/220 R |
| 6,860,722 | B2 * | 3/2005 | Forrester et al. | 416/219 R |
| 7,108,484 | B2 * | 9/2006 | Thenaisie et al. | 416/221 |
| 7,198,463 | B2 * | 4/2007 | Kanebako et al. | 415/175 |
| 7,334,996 | B2 * | 2/2008 | Corbin et al. | 416/221 |
| 7,458,769 | B2 | 12/2008 | Forgue et al. | |
| 7,806,662 | B2 * | 10/2010 | Gekht et al. | 416/221 |
| 7,824,157 | B2 * | 11/2010 | Buisson et al. | 416/220 R |
| 7,938,626 | B2 | 5/2011 | Forgue et al. | |
| 8,186,961 | B2 * | 5/2012 | Stone | 416/221 |
| 8,529,209 | B2 * | 9/2013 | Belmonte et al. | 416/221 |
| 8,535,011 | B2 * | 9/2013 | Mace et al. | 416/219 R |
| 8,616,850 | B2 * | 12/2013 | Ward et al. | 416/204 R |
| 2002/0044870 | A1 * | 4/2002 | Simonetti et al. | 416/221 |
| 2004/0151590 | A1 * | 8/2004 | Forrester et al. | 416/219 R |
| 2005/0207892 | A1 * | 9/2005 | Kanebako et al. | 416/219 R |
| 2005/0254951 | A1 | 11/2005 | Thenaisie et al. | |
| 2009/0016890 | A1 * | 1/2009 | Douguet et al. | 416/219 R |
| 2009/0060745 | A1 | 3/2009 | Douguet et al. | |
| 2009/0081046 | A1 * | 3/2009 | Mace et al. | 416/219 R |
| 2010/0150724 | A1 * | 6/2010 | Forgue et al. | 416/219 R |
| 2010/0189564 | A1 * | 7/2010 | Stone | 416/221 |
| 2010/0226777 | A1 * | 9/2010 | Forgue et al. | 416/221 |
| 2011/0085888 | A1 * | 4/2011 | Gouda et al. | 415/110 |
| 2011/0243744 | A1 | 10/2011 | Forgue et al. | |

OTHER PUBLICATIONS

English translation of Japanese Office Action issued on Feb. 7, 2014 in Japanese Patent Application No. 2012-507727.

* cited by examiner

REINFORCED FAN BLADE SHIM

TECHNICAL FIELD

This invention relates to the field of turbojet fans for aircraft in general, and more particularly to shims designed to be inserted between the root of fan blades and the bottom of compartments defined by the fan disk.

STATE OF PRIOR ART

An exploded view of such a turbojet fan is shown in FIG. 1. It globally comprises a disk 2 centered on the fan axis 4, on which circumferentially spaced teeth 6 are formed at the periphery of the disk, each tooth extending approximately longitudinally and radially and are approximately parallel to the axis 4. Two consecutive teeth 6 in the circumferential direction delimit a compartment 8 between them that will hold the root 12 of a fan blade 10. Each tooth has a widened head to retain the blades in the radially outwards direction, in a known manner. In other words, the compartment 8 has a narrowed external radial end through which the stem of the blade 10 can pass, with a smaller section than its root 12. Thus, the resulting assembly is a dovetail or "fir-tree attachment" type assembly.

Furthermore, the fan 1 comprises a shim 20 associated with each blade 10 and inserted between the lower end of the blade root 12 and a bottom 8*a* of the compartment associated with the blade concerned.

As can be better seen in FIG. 2, the shim 20 blocks the blade 10 in the radially inwards direction, and also participates in forcing the contact surfaces of the root 12 into contact with the energy end of the teeth 6. Furthermore, as can be been in FIG. 1, the shim 20 comprises an axial retention stop 22 for its associated blade, this stop 22 being designed to bear in contact with a retention ring (not shown) supported by the disk 2 and centered on the axis 4.

The shim 20 conventionally comprises a metal stiffener 24 around which one or several external elements 26 made of an elastomer material are placed, therefore this element 26 is in contact with the bottom 8*a* of the compartment and the radially internal end of the root 12 of the blade. In a known manner, each element 26 is made by injection moulding onto the metal stiffener, which is preferably made of titanium. The insert moulding by injection method used bonds the external element 26 made of an elastomer material onto a support surface provided on the stiffener 24.

Although this technological solution is very widely used on turbojets, it can cause separation (delamination) problems of the external element 26. This problem arises essentially when the shim 20 is inserted between the root 12 and the bottom of the compartment 8*a* during installation of the engine and/or during handling operations necessary to insert the shim. As shown diagrammatically in FIG. 1, note that the shim is inserted into its dedicated space by sliding it along its longitudinal direction 30, which is usually slightly curved.

When this type of tearoff occurs, the retention properties of the blade associated with this shim can no longer be satisfied. Furthermore, since the shim also performs a function to reduce vibration within the blade, deterioration of the shim will lead to a reduction in the damping of vibrations occurring on this fan blade during operation.

SUMMARY OF THE INVENTION

Therefore, the purpose of the invention is to at least partially overcome the disadvantages mentioned above related to embodiments according to prior art.

To achieve this, the purpose of the invention is a skin according to claim 1 or 2, Preferably, the shim is in the form of a strip extending along a longitudinal direction, said corrugated zone comprising a plurality of waves succeeding each other along this same direction. The waves thus arranged result in better resistance to delamination of the external element made of an elastomer material, when the shim is inserted between the blade root and the bottom of the compartment. These waves then form direct obstacles to relative displacements between the stiffener and the external element of the shim along the longitudinal direction, which normally corresponds to the direction in which the shim is inserted into its dedicated space under the blade.

Preferably, the external element made of an elastomer material is insert moulded onto the metal stiffener, preferably by high pressure injection Preferably, the metal stiffener is made of titanium.

Another purpose of the invention is a turbojet fan comprising a plurality of fan blades and a disk defining a plurality of compartments around its periphery, the root of each fan blade being housed in one of the compartments and a shim like that described above being inserted between the bottom of the compartment and said root.

Preferably, each shim travels along the root of its associated fan blade.

Preferably, each shim has an axial retention stop for its associated fan blade.

Finally, another purpose of the invention is an aircraft turbojet comprising a fan like that described above.

Other advantages and characteristics of the invention will become clear in the non-limitative detailed description given below.

BRIEF DESCRIPTION OF THE DRAWINGS

This description will be made relative to the appended drawings, among which.

DETAILED DESCRIPTION OF PARTICULAR EMBODIMENTS

Figure 1:
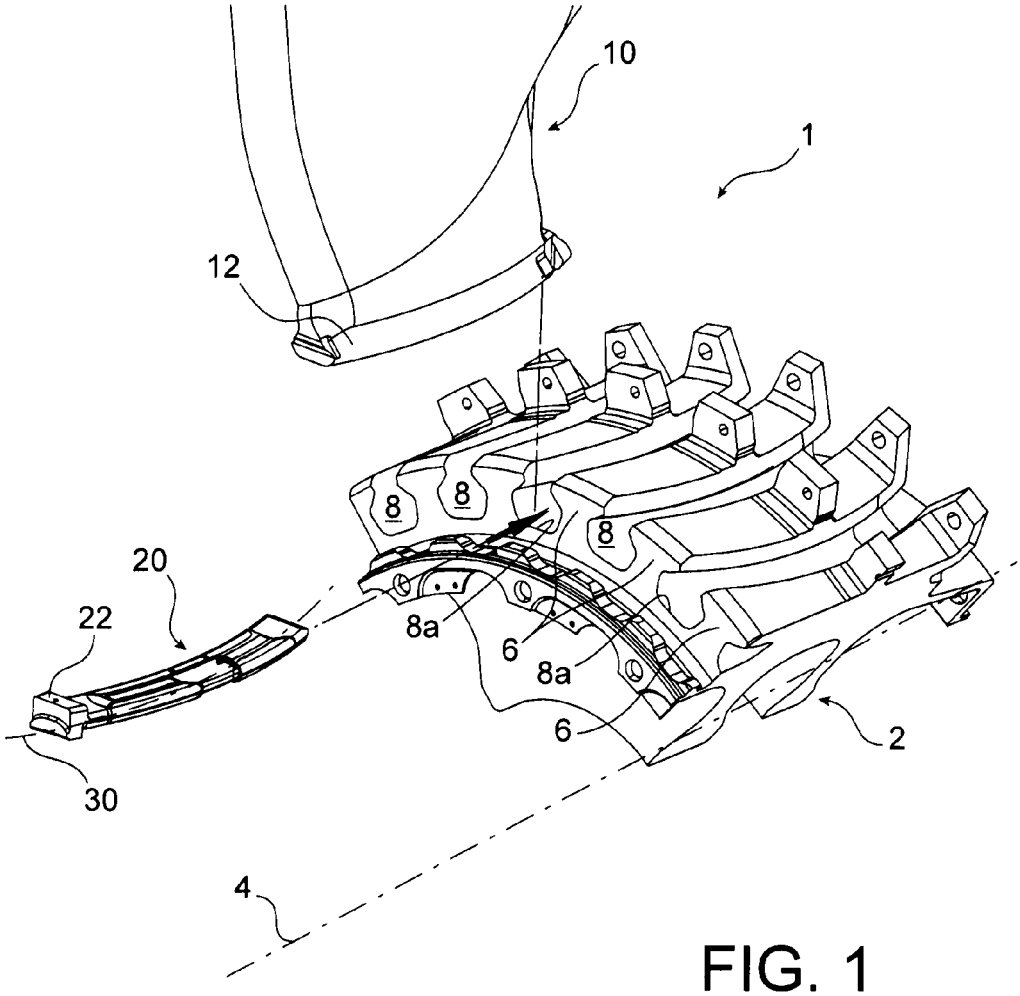
FIG. 1, already described, shows an exploded perspective view of a part of a turbojet fan for an aircraft with a known design according to prior art.
Figure 2:
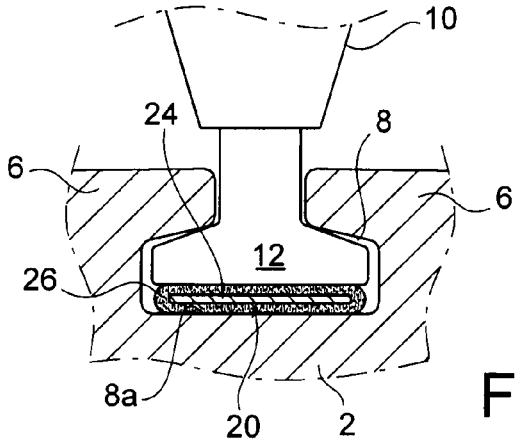
FIG. 2, also previously described, shows a partial cross-sectional view of the fan shown in FIG. 1.
Figure 3:
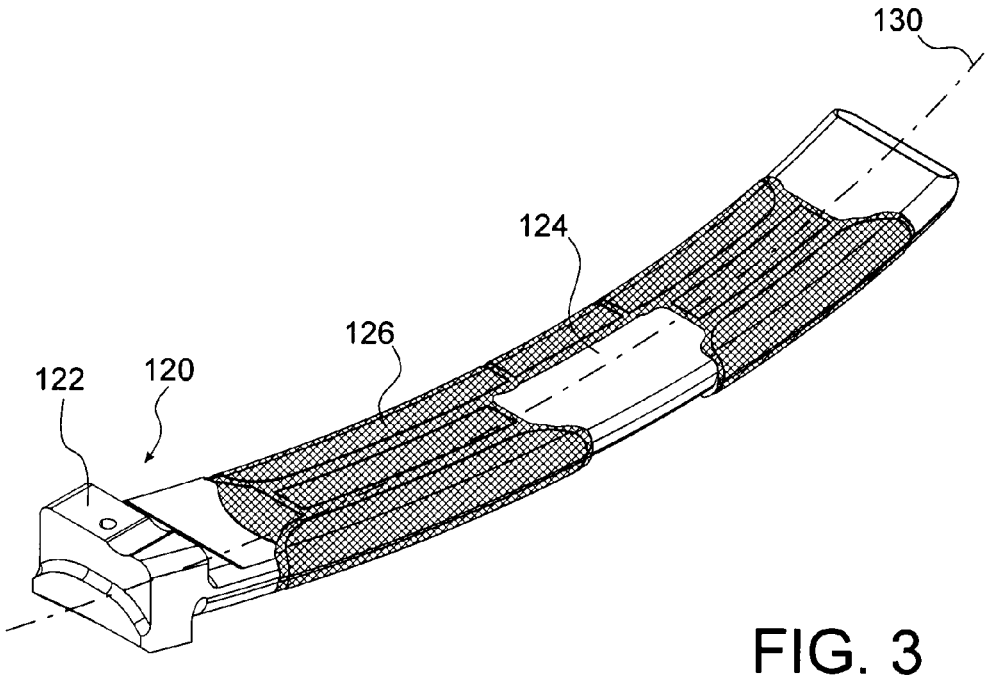
FIG. 3 shows a perspective view of a shim for a turbojet fan according to a preferred embodiment of this invention.

Therefore, FIG. 3 shows a shim 120 made according to a preferred embodiment of this invention. This shim, which has an external shape practically identical to or similar to the shape of the shim 20 according to prior art shown in FIGS. 1 and 2, is also in the general shape of a strip extending along a longitudinal direction 130 with a curved shape corresponding to the direction along which the root 12 of its associated blade and the bottom of the compartment 8*a* also extend. Thus, it should be understood that the shim 120 will be inserted between the blade 10 and the bottom 8*a* of the compartment 8 shown in FIG. 1, always for the purpose of retaining the blade and for damping vibrations of the blade.

FIG. 3 shows that the metal stiffener 124 preferably made of titanium is fitted with an external element made of an elastomer material reference 126 that partially covers the outside surface of this stiffener. In other words, the external element 126 made by high pressure injection moulding of the elastomer material on the stiffener 124, leaves part of the outside surface of this stiffener free.

Figure 4:
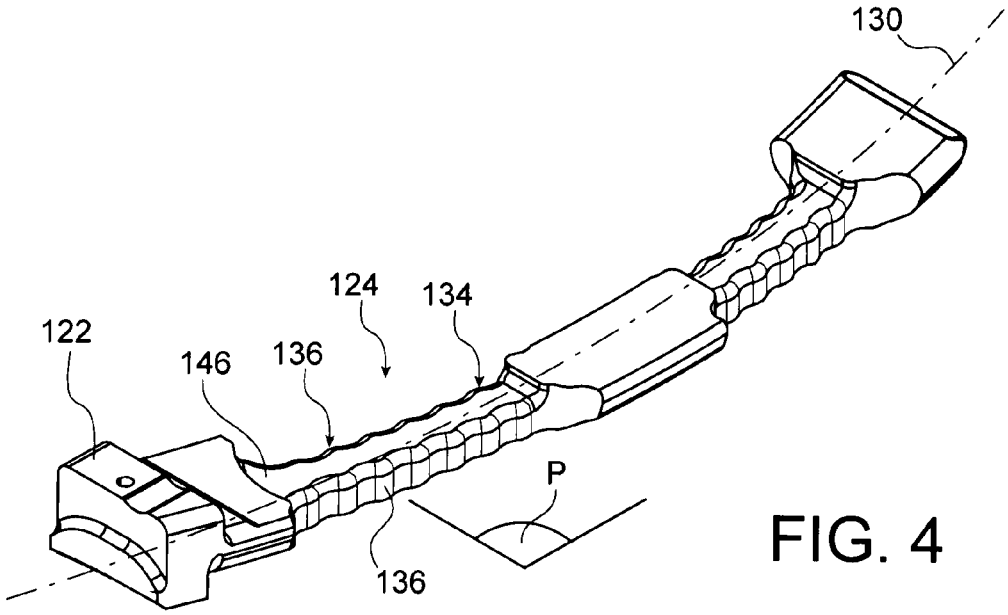
FIG. 4 shows a view similar to that in FIG. 3 in which the external element made of an elastomer material has been removed in order to show only the metal stiffener and its external element support surface.
Figure 4A:
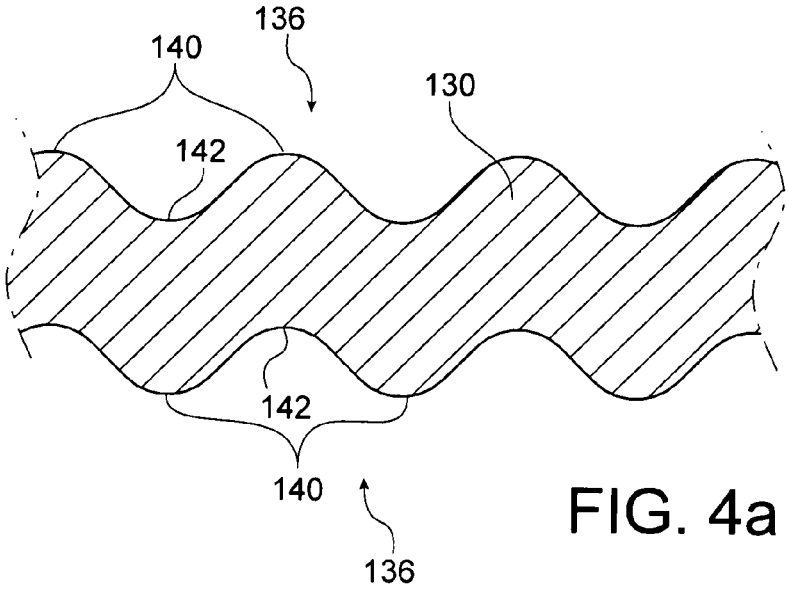
FIG. 4*a* shows a sectional view taken on plane P in FIG. 4*a* including the longitudinal direction of the shim and showing the corrugated zones of the support surface formed by the metal stiffener.

FIG. 4, shows the same stiffener 124 in a state in which it is not yet covered by its external element 126. This makes the support surface 134 of this external element visible in FIGS. 4 and 4*a*, that shows that it has several corrugated zones 136. Each corrugated zone 136 is actually formed from a sequence of waves 140 between which rounded troughs 142 are formed. Thus, during injection moulding of the elastomer material, the elastomer material will penetrate into the troughs 142, which has the two-fold consequence of increasing the bond area of the element 126 on the stiffener 124, and creating a plurality of mechanical engagements of the waves of the stiffener in the troughs of the external element and vice versa.

In this respect, to further reduce risks of delamination of the element 126, it is planned that the waves 140 of each corrugated zone 136 are in sequence along a longitudinal direction 130 in which the shim 120 can normally displace relative to the disk 2, to be inserted between the blade root 12 and the bottom of the compartment 8*a*. As shown in FIG. 4, two corrugated zones 136 are provided and are oriented in opposite directions, one possibly being interrupted at one or several locations, by a portion of the stiffener 124 that will form part of the external surface of the finished shim. Once the shim has been put into place in its compartment, the waves 140 extend along a circumferential direction of the fan disk 2, in the direction of their amplitude.

Furthermore, the two corrugated zones 136 are connected to each other by a radial outer zone 146 and a radial inner zone (not visible in FIG. 4), these two zones being preferably plane and parallel to the direction 130. They also form an integral part of the support surface 134 on which the element made of an elastomer material 126 will bond once the injection moulding is complete.

Obviously, the shim 120 shown herein also has an axial retention stop 122 for its associated fan blade, with the same geometry as the stop 22 shown on the shim 20 in FIG. 1.

Obviously, those skilled in the art can make various modifications to the invention as it has just been described solely through non-limitative examples.

The invention claimed is:

1. A shim configured to be inserted between a root of a fan blade of a turbojet and a bottom of a compartment in which the root is housed, the compartment being delimited by a fan disk, the shim comprising:

a metal stiffener including at least one external element made of an elastomer material, the metal stiffener including a support surface of the external element made of an elastomer material, and the external element is insert molded onto the metal stiffener, wherein the support surface includes at least one corrugated zone, and wherein the shim is in a form of a strip extending along a longitudinal direction, and the corrugated zone comprises a plurality of waves succeeding each other along the longitudinal direction.

2. A shim according to claim 1, wherein support surface includes two corrugated zones oriented in opposite directions.

3. A shim according to claim 1, wherein the metal stiffener is made of titanium.

4. A shim according to claim 1, wherein the external element surrounds a periphery of the metal stiffener.

5. A turbojet fan comprising:

a plurality of fan blades and a disk defining a plurality of compartments around its periphery, the root of each fan blade being housed in one of the compartments and a shim according to claim 1 being inserted between the bottom of the compartment and said root.

6. A fan according to claim 5, wherein each shim travels along the root of its associated fan blade.

7. A fan according to claim 5, wherein each shim includes an axial retention stop for its associated fan blade.

8. A fan according to claim 6, wherein each shim includes an axial retention stop for its associated fan blade.

9. An aircraft turbojet comprising a fan according to claim 5.

10. A shim configured to be inserted between a root of a fan blade of a turbojet and a bottom of a compartment in which the root is housed, the compartment being delimited by a fan disk, the shim comprising:

a metal stiffener including at least one external element made of an elastomer material, the metal stiffener including a support surface of the external element made of an elastomer material, and the external element is insert molded onto the metal stiffener, wherein the support surface includes at least one corrugated zone.

* * * * *

UNITED STATES PATENT AND TRADEMARK OFFICE

CERTIFICATE OF CORRECTION

PATENT NO. : 8,870,545 B2
APPLICATION NO. : 13/265200
DATED : October 28, 2014
INVENTOR(S) : Patrick Jean-Louis Reghezza et al.

It is certified that error appears in the above-identified patent and that said Letters Patent is hereby corrected as shown below:

In the Specification

In column 1, line 32, the text "can be been" should read --can be seen--.

In column 2, line 1, the text "is a skin" should read --is a shim--.

Signed and Sealed this
Eighteenth Day of August, 2015

Michelle K. Lee

Michelle K. Lee
*Director of the United States Patent and Trademark Office*